United States Patent [19]

Montealegre

[11] 4,318,470

[45] Mar. 9, 1982

[54] CARTON WITH CELLS AND BLANK FOR FORMING SAME

[75] Inventor: James Montealegre, W. St. Paul, Minn.

[73] Assignee: Champion International Corporation, Stamford, Conn.

[21] Appl. No.: 137,237

[22] Filed: Apr. 4, 1980

[51] Int. Cl.[3] ..... B65D 5/10

[52] U.S. Cl. ..... 206/180; 206/183; 229/27

[58] Field of Search ..... 206/180, 175, 181, 182, 206/183, 186, 187, 188, 491; 229/16 R, 27, 28 R, 29 D

[56] References Cited

U.S. PATENT DOCUMENTS

| | | | |
|---|---|---|---|
| 2,529,675 | 11/1950 | Brulin | 229/27 X |
| 2,747,785 | 5/1956 | Fink | 206/183 X |
| 3,158,286 | 11/1964 | Phillips, Jr. | 206/180 |
| 3,989,181 | 11/1976 | Wilcox et al. | 229/27 X |

*Primary Examiner*—Steven M. Pollard
*Attorney, Agent, or Firm*—Evelyn M. Sommer

[57] ABSTRACT

A carton with a plurality of cells and a handle and a blank for forming same have a collapsible arrangement for automatically forming a bottom, partitions and a handle. This arrangement includes bottom panels hingedly coupled to the bottom edges of the wall panels, divider panels separated into first and second sections hingedly coupled to two of the bottom panels at edges thereof remote from the wall panels, and a handle structure coupled to the divider panels at edges thereof remote from the bottom panels. This permits the carton to be shipped and stored in an essentially flat, collapsed configuration and then easily arranged to its assembled, expanded configuration by the application of inwardly directed forces against the side edges of the collapsed carton. These forces cause the bottom panels, divider panels and handle structure to move automatically with the movement of the side wall panels of the carton.

12 Claims, 9 Drawing Figures

CARTON WITH CELLS AND BLANK FOR FORMING SAME

BACKGROUND OF THE INVENTION

1. Field of the Invention

The present invention relates to a carton having a plurality of cells and a handle, and a blank for forming the carton. More particularly, the invention relates to a collapsible arrangement for automatically forming a bottom, partitions and a handle which permits shipment of the partially assembled carton in a substantially flat, collapsed configuration, while allowing complete assembly and set up by simple manual operation without the use of glue during final assembly.

2. Description of the Prior Art

In constructing cartons or containers for certain articles, it is often necessary to provide a plurality of separate cells or compartments in the carton and a handle to facilitate carrying of the carton. The separate carton cells facilitate packing of the carton and insulate the articles from each other to prevent contact therebetween and damage. A handle for carrying the carton must be capable of supporting the articles in the carton without collapsing the carton.

U.S. Pat. No. 2,888,185 to Porter discloses a carton having a plurality of longitudinal cells therein and a planar, unitary blank for forming the carton. The divider panels of the carton are formed from a lateral extension of one of the side wall panels, while the bottom comprises panels hingedly coupled to the bottom edges of the side wall panels which are secured in place by the frictional engagement of a tuck flap. In the Porter carton no handle is provided. Additionally, the weight of the articles in the container is borne fully by the frictional engagement of the tuck flap and the various panels engaged therewith. Thus, the Porter carton is deficient in not having suitable handle means and failing to have a strong bottom arrangement.

U.S. Pat. No. 3,283,950 to Bolding discloses a carton having a plurality of cells and a handle. The divider panels partitioning the cells within the carton extend for only a portion of the height of the carton. The handle is attached only to the top closure arrangement, and is not coupled directly to the divider panels. Thus, the handle is incapable of supporting the full load placed on the bottom of the carton by the articles placed therein. Moreover, the Bolding carton is not collapsible to permit shipment in a collapsed configuration and final assembly without the use of glue.

Other patents disclosing cartons with a plurality of cells and handle arrangements are U.S. Pat. No. 3,365,098 to Sims, U.S. Pat. No. 3,355,012 to Weiss, and U.S. Pat. No. 4,047,610 to Stout et al. The cartons disclosed in these patents are likewise deficient for the reasons enumerated above.

SUMMARY OF THE INVENTION

Since the carton manufacturer may be located far from where the articles are packed within the carton, the carton must be capable of being shipped and stored in a flat, collapsed configuration to use shipping and storage space efficiently. Otherwise, the carton would waste considerable space and prevent economical shipment and storage.

Once at the packing location, the partically assembled carton must be capable of full assembly easily without the use of skilled personnel or complex machinery.

Thus, the action necessary to convert the carton from its partially assembled, collapsed configuration to its fully assembled state must be extremely quick and simple. Additionally, the carton so formed must be capable of supporting considerable weight without collapsing.

Accordingly, it is an object of the present invention to provide a carton and a blank for forming a carton with a plurality of cells and a handle which is collapsible so that the carton may be shipped and stored in a flat, partially assembled, collapsed configuration.

Another object of the present invention is to provide a carton and a blank for forming a carton with a plurality of cells and a handle that may be simple and quickly converted from a partially assembled, collapsed configuration to a fully assembled configuration without skilled personnel and without complex folding and gluing machinery or operations.

An additional object of the present invention is to provide a carton with a collapsible arrangement for automatically forming a bottom, partitions and a handle and a blank for forming same in which the handle fully supports the weight of the articles placed within the carton.

An additional object of the present invention is to provide a carton and a unitary blank for forming a carton with a plurality of cells and a handle which is of rugged construction and which is simple and inexpensive to manufacture, assemble and use.

The foregoing objects are attained by providing a carton with a plurality of cells, comprising first, second, third and fourth wall panels hingedly coupled at adjacent side edges thereof along fold lines, and collapsible means for automatically forming a bottom, partitions and a handle, the means being hingedly coupled to bottom edges of the wall panels along fold lines and comprising first, second, third and fourth bottom panels hingedly coupled to bottom edges of the first, second, third and forth wall panels, respectively, along fold lines, first and second divider panels hingedly coupled to the first and third bottom panels, respectively, at end edges thereof remote from the wall panels along fold lines, the first and second divider panels each separated into first and second sections by fold lines extending perpendicular to the fold lines between the wall and bottom panels, and a handle coupled to the divider panels at an end edge thereof remote from the bottom panels.

The foregoing objects are also attained by a planar, unitary blank for forming a carton with a plurality of cells, comprising first, second, third and fourth side panels sequentially arranged and hingedly coupled at adjacent side edges thereof along fold lines, first, second, third and fourth bottom panels hingedly coupled to the first, second, third and fourth side panels, respectively, at end edges thereof along fold lines, first and second divider panels hingedly coupled to the first and third bottom panels, respectively, at end edges thereof remote from the side panels along fold lines, the first and second divider panels each separate into first and second sections by fold lines extending perpendicular to the fold lines between the side and bottom panels, and at least one handle panel coupled to one of the divider panels at an end edge thereof remote from the respective bottom panel.

By forming the carton and the blank of the present invention in this manner, a carton may be provided which may be partially formed and shipped in a flat, collapsed configuration and then easily and simply rearranged to a fully assembled configuration in which the carton has a plurality of cells and a handle which fully supports the load of the articles placed upon the bottom of the carton. The rearrangement is accomplished by simple manipulation without gluing, complex machinery or operations, or skilled personnel. Thus, the present invention permits cartons formed with a plurality of cells and a handle to be easily and economically manufactured, shipped and stored.

Other objects, advantages and salient features of the present invention will become apparent from the following detailed description, which taken in conjunction with the annexed drawings, discloses a preferred embodiment of the present invention.

As used in this application, the terms "first," "second," "third," "fourth," "side," "end," "top" and "bottom" are intended to facilitate the description of the carton and the blank for forming the carton. Thus, such terms are merely illustrative of the carton and blank and are not intended to limit the carton or blank to any specific orientation.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
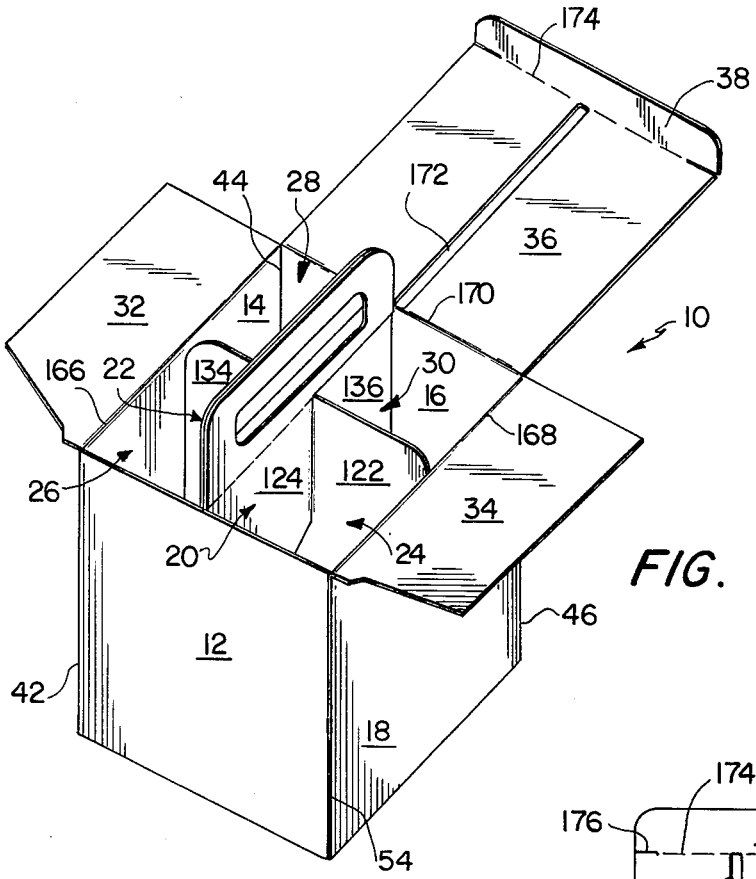
FIG. 1 is a perspective view illustrating the carton of the present invention in its fully assembled, open configuration.

Referring to FIG. 1, the carton 10 in its assembled configuration has four side wall panels 12, 14, 16, 18. Panels 12, 16 are opposed and parallel to each other. Panels 14, 18 are opposed and parallel to each other and perpendicular to the side wall panels 12, 16. These panels are coupled along their adjacent side edges.

A collapsible arrangement is hingedly coupled to the bottom edges of the wall panels 12, 14, 16, 18 for automatically forming partitions 20, a bottom and a handle 22. As will be discussed in greater detail hereinafter, the handle 22 and the bottom are coupled to opposite end edges of the partitions 20, and the bottom is coupled to the bottom edges of the side wall panels. The partitions 20 divide the interior of the carton into four cells or compartments 24, 26, 28, 30.

Two top flaps 32, 34 are hingedly coupled to the top edges of the panels 14, 18, respectively. A cover panel 36 having a tuck flap 38 is hingedly coupled to the top edge of the third side wall panel 16. The panel 36 and the flaps 32, 34 close the top of the carton 10 while permitting the handle 22 to be exposed.

Figure 2:
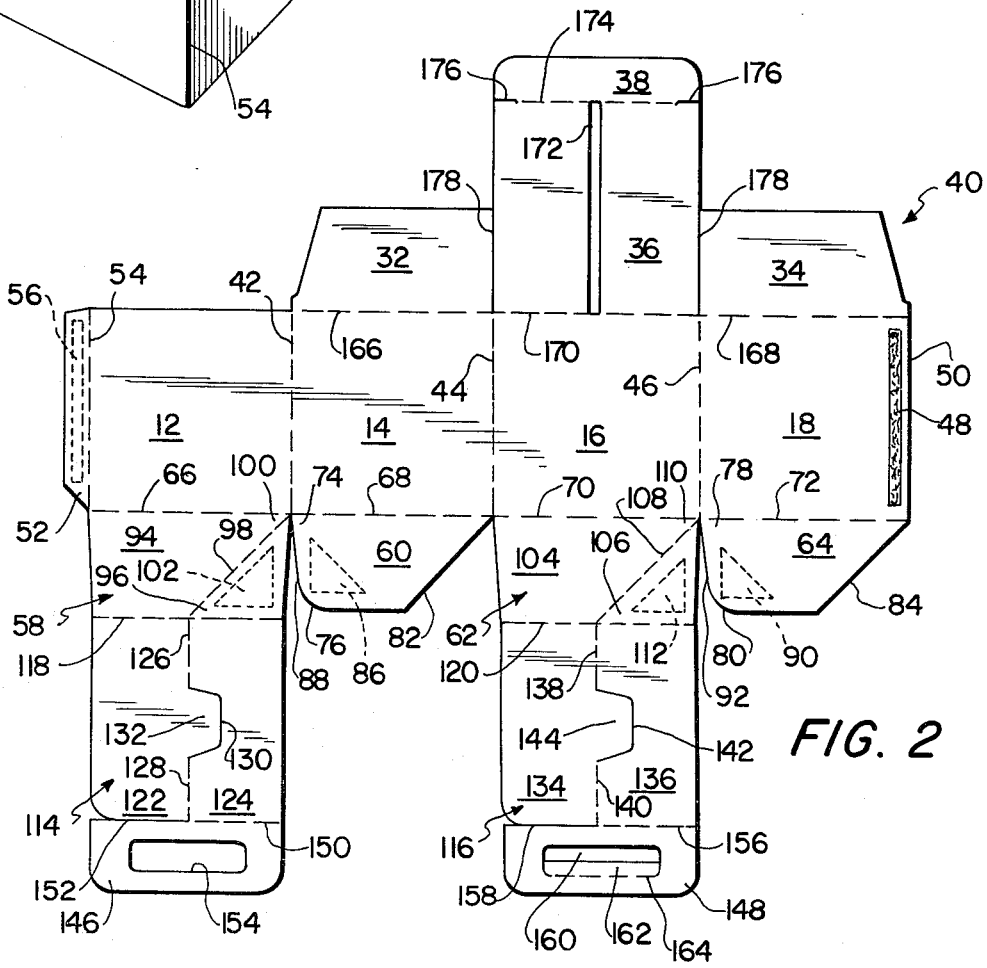
FIG. 2 is a plan view illustrating the interior surface of a blank for forming the carton of FIG. 1.

The blank 40 for forming the carton 10 is illustrated in FIG. 2. The blank 40 may be formed of a unitary piece of paperboard of suitable weight and thickness. The weight and thickness of the paperboard depends on the size and weight of the articles contained within the carton 10. FIG. 2 illustrates the surface of the blank 40 which will form the interior surface of the carton 10 as illustrated in FIG. 1.

The central portion of the blank 40 comprises the four rectangular side wall panels, 12, 14, 16, 18 of equal size. The first side wall panel 12 is hingedly coupled to the second side wall panel 14 at adjacent side edges thereof along a fold line 42. The second side wall panel 14 is hingedly coupled at its side edge remote from panel 12 to the third side wall panel 16 at a side edge thereof along the fold line 44. The third side wall panel 16 is hingedly coupled at its side edge remote from panel 14 to the fourth side wall panel 18 at a side edge thereof along the fold line 46.

The fourth side wall panel 18 has an elongated glue area 48 on the interior surface thereof adjacent the free side edge 50 of the panel 18. A trapezoidal glue flap 52 is hingedly coupled at its longer parallel base to the side edge of the first side wall panel 12 remote from the second side wall panel 14 along a fold line 54. The glue flap 52 has a glue area 56 on the exterior surface thereof shaped and located to mate with the glue area 48 on the side wall panel 18.

Four bottom panels 58, 60, 62, 64 are hingedly coupled to bottom end edges of the side wall panels 12, 14, 16, 18, respectively, along colinear fold lines 66, 68, 70, 72. The first and third bottom panels 58, 62 are identical. The second and fourth bottom panels are identical.

The second and fourth bottom panels 60, 64 are generally trapezoidal with their longer parallel base hingedly coupled to the side wall panels 14, 18, respectively. The corners 74, 76 of the bottom panel 60 and the corners 78, 80 of the bottom panel 64 which are adjacent the bottom panels 58, 62, respectively, have included angles of approximately 90°. The corners 76, 80 remote from the fold lines 68, 72, respectively, are rounded. The side edges 82, 84 of the bottom panels 60, 64, respectively, remote from the panels 58, 62, respectively, extend at acute angles of approximately 45° relative to the fold lines 68, 72, respectively. The second bottom panel 60 has a glue area 86 on the exterior surface thereof adjacent its side edge 88 adjacent the first bottom panel 58. Similarly, the fourth bottom panel 64 has a glue area 90 adjacent its side edge 92 adjacent the third bottom panel 62.

The first and third bottom panels 58, 62 are generally rectangular. The first bottom panel 58 is separated into first and second portions 94, 96 by an angled fold line 98. The fold line 98 extends from the corner 100 of the panel 58 adjacent the side wall panel 12 and the second bottom panel 60 at an acute angle of approximately 45° relative to the fold line 66 and terminates on the end edge of the panel 58 remote from the panel 12. The first portion 94 is trapezoidal, while the second portion 96 is in the form of a right isosceles triangle with its hypotenuse along the fold line 98. A glue area 102 is provided on the exterior surface of the second portion 96 of the first bottom panel 58 and is located and shaped to mate with the glue area 86 on the second bottom panel 60.

Similarly, the third bottom panel 62 is separated into a first trapezoidal portion 104 and a second portion 106 in the form of a right isosceles triangle by an angled fold line 108. The angled fold line 108 extends from the corner 110 of the bottom panel 62 adjacent the side panel 16 and the fourth bottom panel 64 at an acute angle of approximately 45° relative to the fold line 70, and terminates on the end edge of the panel 62 remote from the side panel 16. A glue area 112 is provided on the exterior surface of the second portion 106 of the third bottom panel 62 and is shaped and oriented to mate with the glue area 90 on the fourth bottom panel 64.

Generally rectangular divider panels 114, 116 are hingedly coupled to the first and third bottom panels 58, 62, respectively, at the end edges thereof remote from the side panels 12, 16, respectively. The first divider panel 114 is hingedly coupled to the bottom panel 58 along the fold line 118. The second divider panel 116 is hingedly coupled to the third bottom panel 62 along the fold line 120. Each of the divider panels 114, 116 are substantially identical in shape.

The first divider panel 114 is separated into two sections 122, 124 by the fold line segments 126, 128. The fold line segments 126, 128 are discontinuous and colinear, and extend from opposite end edges of the divider panel 114 perpendicular to the fold line 118. The first fold line segment 126 extends from the fold line 118 at the juncture thereof with angled fold line 98. The adjacent ends of the fold line segments 126, 128 are interconnected by a generally U-shaped slit 130. The U-shaped slit 130 defines a tab 132 which is formed from a portion of the second section 124 and which is an extension of the first section 122. Since the sides of the U-shaped slit 130 are angled relative to the base thereof, the tab 132 is trapezopidal with its longer parallel base colinear with the fold line segments 126, 128.

Similarly, the second divider panel 116 has first and second sections 134, 136 separated by fold line segments 138, 140. The fold line segments 138, 140 are discontinuous and colinear, and extend from opposite end edges of the second divider panel 116. The first fold line segment 138 extends from the fold line 120 at the juncture thereof with the angled fold line 108. The adjacent ends of the fold line segments 138, 140 are interconnected by a U-shaped slit 142. The U-shaped slit defines a tab 144 which is formed from a portion of the second section 136 and which is an extension of the first section 134. The tab 144 is shaped and oriented similar to the tab 132. Both tabs 132, 144 extend in the same direction.

First and second handle panels 146, 148 are coupled to the first and second divider panels 114, 116, respectively, at end edges thereof remote from the bottom panels 58, 62. The first handle portion 146 is hingedly coupled to the second section 124 of the divider panel 114 along a fold line 150. The remaining half of the juncture between the divider panel 114 and the handle panel 146 (i.e., that portion between the first section 122 and the panel 146) has a slit 152. An elongated hand opening 154 is formed in the central portion of the handle panel 146.

The second handle panel 148 is hingedly coupled along a fold line 156 to the second section 136 of the second divider panel 116. The remaining half of the juncture between the divider panel 116 and the second handle panel 148 (i.e., that portion adjacent the first section 134) has a slit 158. An elongated hand opening 160 is formed in the center section of the second handle panel 148. A handle flap 162 is hingedly coupled to the elongated edge of the opening 160 remote from the divider panel 116.

The second and fourth side wall panels 14, 18 have first and second top flaps 32, 34 hingedly coupled to the top end edges thereof along fold lines 166, 168, respectively. The flaps 32, 34 are of conventional configuration and size.

The third side wall panel 16 has a cover panel 36 hingedly coupled to the top end edge thereof along the fold line 170. The cover panel 36 is rectangular and has a narrow, elongated slot 72 extending along the entire length thereof perpendicular to the fold line 170 and equally spaced from the side edges of the panel 36. The tuck flap 38 is hingedly coupled to the end edge of the cover panel 36 remote from the side wall panel 16 along a fold line 174. The opposite ends of the fold line 174 have slits 176. The flaps 32, 34 are separated from the cover panel 36 by slits 178 to permit independent folding thereof.

Figure 3:
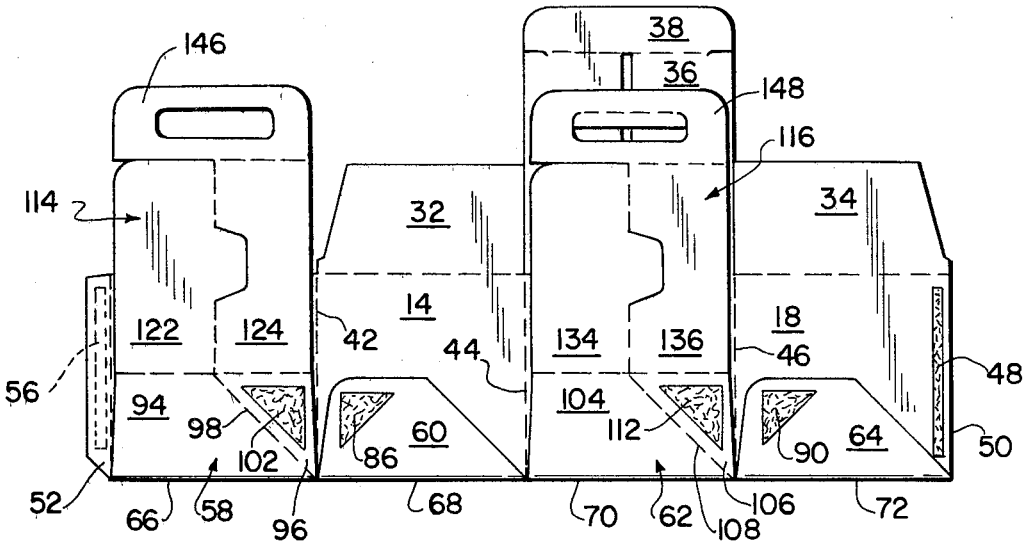
FIGS. 3 and 4 are plan views illustrating the blank of FIG. 2 in various stages of folding and gluing.

The carton 10 is formed from the blank 40 of FIG. 2 by folding the bottom panels 58, 60, 62, 64 about lines 66, 68, 70, 72, respectively, to the position illustrated in FIG. 3. In this position, the bottom panels 58, 60, 62, 64 overlie the interior surfaces of the side wall panels 12, 14, 16, 18, respectively. The divider panel 114 and the handle panel 146 remain coplanar with the first bottom panel 58. Similarly, the second divider panel 116 and the second handle panel 148 remain coplanar with the third bottom panel 62. This exposes the glue areas 102, 86, 112, 90.

Figure 4:
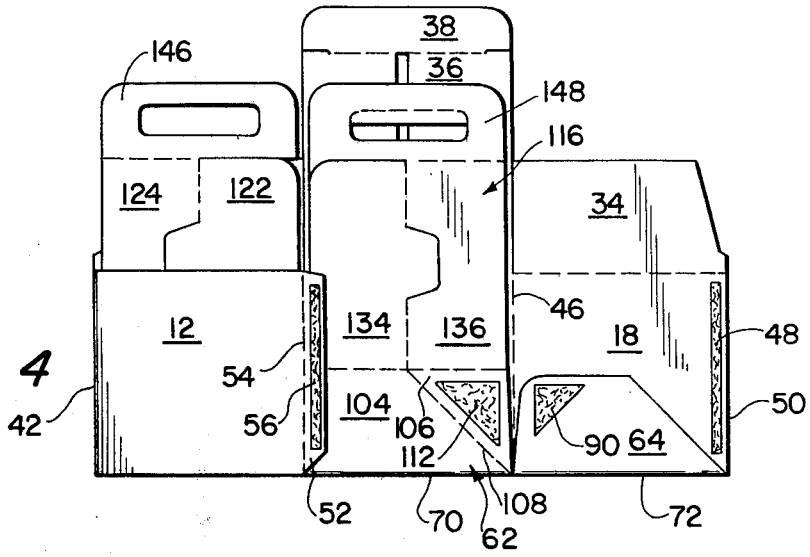

As illustrated in FIG. 4, the first side wall panel 12 is folded about line 42 until the first bottom panel 58 overlies the second bottom panel 60. The bottom panel 58, the divider panel 114 and the handle panel 146 are folded with the side wall panel 12. In this position, the glue areas 102, 86 mate. The adhesive on area 102 and/or area 86 fixes the second portion 96 of the first bottom panel 58 to the second bottom panel 60 and hingedly couples the first portion 94 to the bottom panel 60 along the fold line 98. Additionally, the glue area 56 on the glue flap 52 is exposed. The glue flap 52 remains coplanar with the first side wall panel 12.

Figure 5:
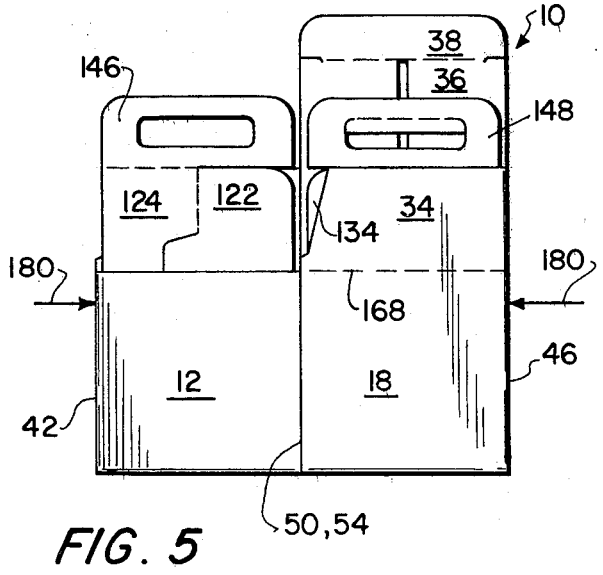
FIG. 5 is a top plan view illustrating the blank of FIG. 2 after it has been folded and glued to the partially assembled, collapsed configuration of the carton of FIG. 1.

After the panels 12, 58, 114, 146 have been folded to the position illustrated in FIG. 4, the fourth side wall panel 18, the fourth bottom panel 64 and the second top flap 34 are folded about line 46 until the panels 18, 64 and the flap 34 overlie the third bottom panel 62 and the second divider panel 116 which are overlying the panels 16, 36, as illustrated in FIG. 5. In the FIG. 5 position, the glue areas 112, 90 mate and the glue areas 56, 48 mate. The adhesive on the area 56 and/or the area 48 hingedly couples the side wall panels 12, 18 along the fold line 54. In this position, the free edge 50 is aligned with the fold line 54. The adhesive on the area 112 and/or the area 90 fixes the second portion 106 of the third bottom panel 62 to the fourth bottom panel 64 to hingedly couple the fourth bottom panel 64 to the first portion 104 of the third bottom panel 62 along the fold line 108.

Figure 6:
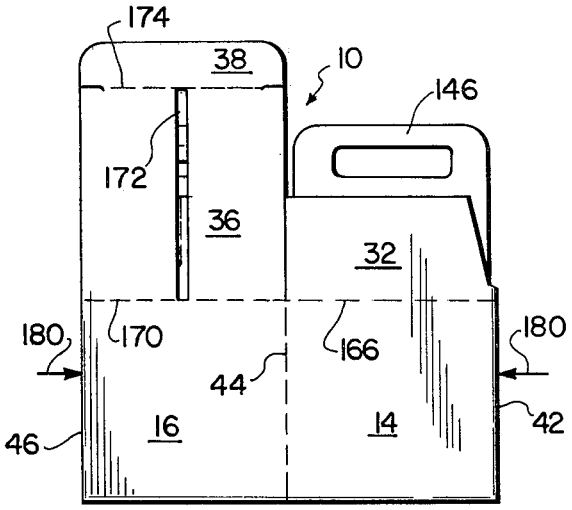
FIG. 6 is a bottom plan view of the carton of FIG. 5.

The blank 40 is now in the configuration illustrated in FIGS. 5 and 6. This configuration represents the partially assembled, collapsed configuration of the carton 10 in which it may be shipped, stored and fully assembled simply, inexpensively and efficiently. FIG. 5 is a top plan view of the collapsed configuration of the carton 10, while FIG. 6 is a bottom plan view of the collapsed configuration of the carton 10.

Figure 9:
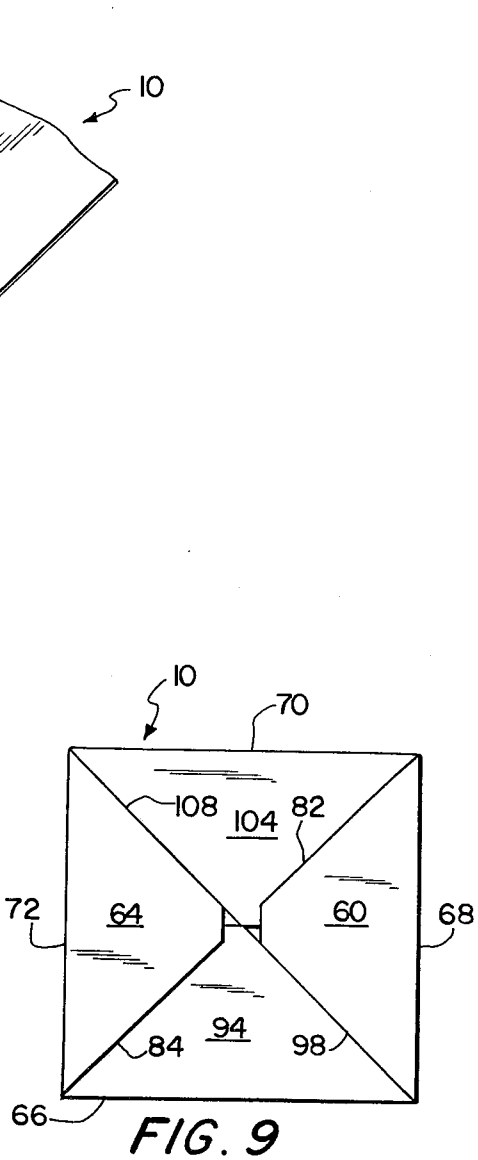
FIG. 9 is a bottom plan view of the carton of FIG. 1.
Figure 8:
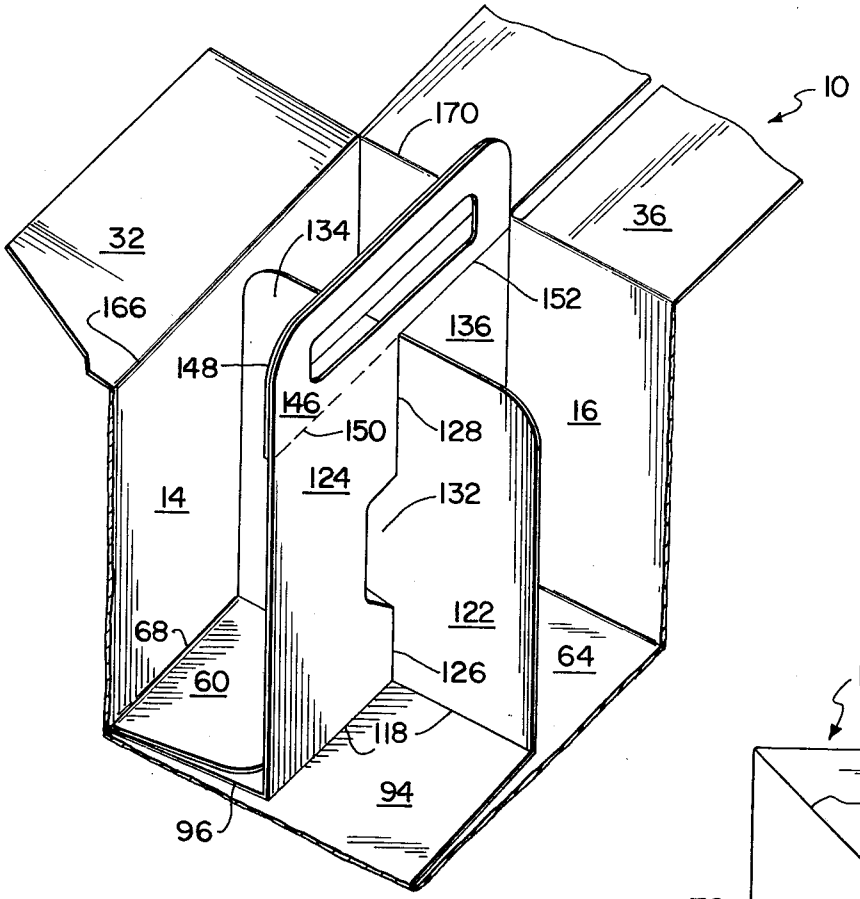
FIG. 8 is a perspective view, partially sectioned of the carton of FIG. 1.
Figure 7:
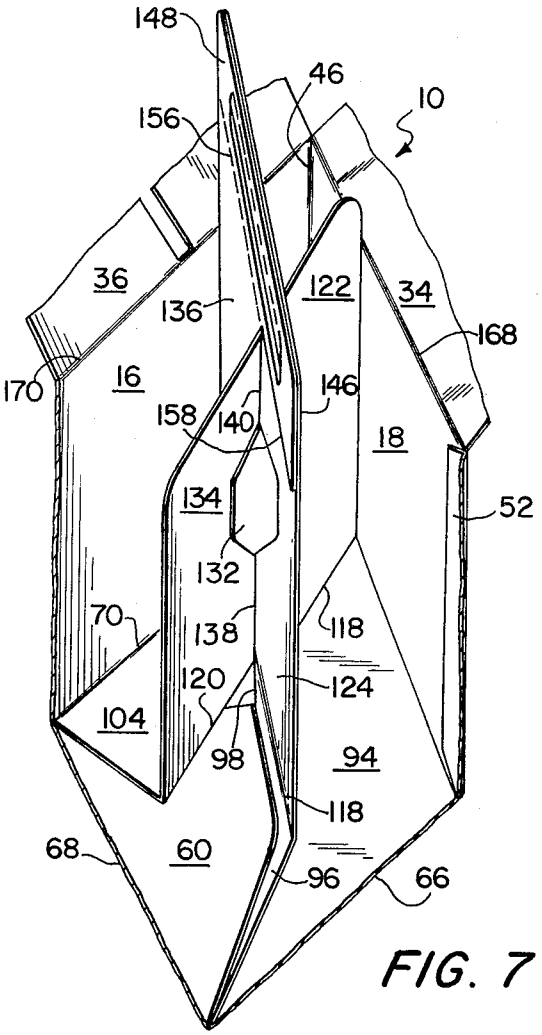
FIG. 7 is a perspective view, partially sectioned, illustrating the carton of FIG. 1 in a partially collapsed configuration.

The fully assembled configuration of FIGS. 1, 8 and 9 is achieved from the partially assembled, collapsed configuration of FIGS. 5 and 6 by applying opposing forces, represented by arrows 180, against the side edges (i.e., fold lines 42, 46) of the collapsed configuration of FIGS. 5 and 6. As illustrated in FIG. 7, these forces cause the carton 10 to open up or expand with the panels 12, 14, 16, 18 pivoting about fold lines 54, 42, 44, 46 away from their collapsed position towards a position in which the first and third side wall panels 12, 16 are parallel, and the second and fourth side wall panels, 14, 18 are parallel to each other and perpendicular to the first and third side wall panels 12, 16 as illustrated in FIG. 1. As the panels 12, 14, 16, 18 are pivoting towards a fully assembled position to form the side walls of the carton 10, the partitions 20, the bottom and the handle 22 automatically move into their assembled orientation to divide the interior of the carton into four cells and form the bottom and the handle for the carton. The partitions 20 comprise the divider panels 114, 116. The handle 22 comprises the handle panels 146, 148. The bottom comprises the bottom panels 58, 60, 62, 64.

The connection between the first and second bottom panels 58, 60 and the connection between the third and fourth bottom panels 62, 64 described hereinabove, automatically causes the bottom panels 60, 64 and the first portions 94, 104 of the bottom panels 58, 60 to pivot downwardly from their collapsed position against the interior surfaces of their respective side wall panels to a position in which they are perpendicular to their respective side wall panels to form the bottom of the carton 10 (see FIG. 9). As the panels 60, 64 and the first portions 94, 104 pivot downwardly, the second portions 96, 106 of the first and third bottom panels 58, 62 pivot about fold lines 98, 108 relative to the first portions 94, 104, respectively, until the second portions 96, 106 overlie interior surfaces of the first portions 94, 104, respectively.

The pivoting action of the second portions 96, 106 relative to the first portions 94, 104 about the fold lines 98, 108 automatically causes the first sections 122, 134 of the divider panels 114, 116 to pivot with respect to the second sections 124, 136 about the fold line segments 126, 128 and 138, 140, respectively. The first and second sections 122, 124 of the first divider panel 114 pivot from a coplanar orientation to a perpendicular orientation. Similarly, the first and second sections 134, 136 of the second divider panel 116 pivot from a coplanar orientation to a perpendicular orientation. As the second sections 124, 136 move toward their assembled configuration the free side edges of the bottom panel second portions 96, 106 slide against the interior surfaces of the first and third side wall panels 12, 16. The frictional engagement between these side edges and the panels 12, 16 retains the carton 10 in its assembled configuration against the inherent bias or tendency of the carton to resume its collapsed configuration.

As the sections of the divider panels 114, 116 are pivoting, adjacent surfaces of the first sections 122, 134 slide against each other until the fold line segments 126, 138 lie adjacent one another and the fold line segments 128, 140 lie adjacent one another. As the first sections 122, 134 are sliding relative one another, the tabs 132, 134 engage and slide against surfaces of the divider panel second sections 136, 124, respectively, to retain the second sections 136, 124 in their proper orientation relative to the other divider panel sections.

As the divider panel sections 122, 124, 134, 136 fold automatically, the handle panels 146, 148 automatically move into their proper position. The first handle portion 146 moves with and remains coplanar with the second section 124 of the divider panel 114. As the second section 124 folds relative to the first section 122, the first handle panel 146 separates from the first section 122 along the slit 152. Similarly, as the second section 136 moves relative to the first section 134, the second handle panel 148 moves with and remains coplanar with the second section 136 and separates from the first section 134 along the slit 158. In their assembled configuration, the handle panels 146, 148 overlie one another with the openings 154, 160 aligned as illustrated in FIGS. 1 and 8.

With the carton in its fully assembled or set up configuration illustrated in FIGS. 1 and 8, the carton 10 is ready for packing. Any suitable articles may be placed within one or more of the cells 124, 126, 128, 130. After the carton 10 has been packed with the desired articles, the carton 10 is closed by folding the top flaps 32, 34 relative to the second and fourth side wall panels 14, 18 about lines 166, 168 to a position in which the flaps 32, 34 are perpendicular to the panels 12, 14, 16, 18. Thereafter, the cover panel 36 is folded relative to the third side wall panel 16 about the fold line 170, while simultaneously inserting the handle panels 146, 148 through the elongated slot 172 until the cover panel 36 overlaps the flaps 32, 34 and is generally perpendicular to the panels 12, 14, 16, 18. Additionally, the tuck flap 38 is folded about line 174 relative to the cover panel 36 and is inserted between the interior surface of the first side wall panel 12 and the side edges of the top flaps 32, 34 adjacent thereto to lock the carton 10 in a closed, assembled configuration.

In the closed, assembled configuration, the handle panels 146, 148 extend perpendicularly through the cover panel 36 so that they are exposed for gripping and carrying of the packed carton. When gripped, the handle flap 162 may be folded about line 164 through the handle openings 154, 160 to lie against the face of the handle panel 146 opposite the handle panel 148. In this position, the handle flap 162 secures the handle panels 146, 148 together and provides a smooth and rounded gripping surface for the carrier.

As illustrated in FIG. 1, sections 124, 122 define the first cell 24, the sections 124, 134 define the second cell 26, the sections 134, 136 define the third cell 28, and the sections 122, 136 define the fourth cell 30.

If desired, the carton may be again arranged in the collapsed configuration of FIGS. 5 and 6 by opening the top of the carton, and by applying inwardly directed forces against the edges of the carton 10 formed by the fold lines 44, 54 and freeing the free edges of the bottom panel second portions 96, 106 from their frictional engagement with the interior surfaces of the panels 12, 16. This will cause the side wall panels 12, 14, 16, 18, the bottom panels 58, 60, 62, 64, the divider panels 114, 116, and the handle panels 146, 148 to assume their flat, collapsed configuration of FIGS. 5 and 6. Once the carton 10 has been rearranged to its collapsed configuration it may be efficiently shipped and stored for reuse or disposal.

By forming and folding the blank 40 and the carton 10 in this manner, the carton 10 may be shipped and stored in a substantially flat, collapsed configuration. The flat, collapsed carton may then be easily and simply formed into a fully assembled carton having a plurality of cells and a handle supporting the full load on the bottom of the carton by simply applying force to the edges of the carton 10 formed by the fold lines 42, 46. Thus, when the carton is to be packed, the packer receives the carton 10 in its collapsed configuration and then simply assembles it without gluing, complex machinery or operations or skilled personnel.

Since the handle panels 146, 148 and the bottom panels 58, 62 are directly coupled to the opposite ends of the divider panels 114, 116 which partition the carton 10, the full load of the articles placed on the bottom of the carton is supported by the handle. This enables the carton to support greater loads than if the load is not fully supported by the handle by the direct coupling of the bottom panels and the handle panels to the opposite ends of the divider panels.

While a particular embodiment has been chosen to illustrate the invention, it will be understood by those skilled in this art that various changes and modifications can be made therein without departing from the scope of the invention as defined in the appended claims.

What is claimed is:

1. A carton with a plurality of cells, comprising: first, second, third and fourth wall panels hingedly coupled at adjacent side edges thereof along fold lines; and collapsible means for automatically forming a bottom, partitions and a handle, said means being hingedly coupled to bottom edges of said wall panels along fold lines and comprising, first, second, third and fourth bottom panels hingedly coupled to bottom edges of said first, second, third and fourth wall panels, respectively, along fold lines, first and second divider panels hingedly coupled to said first and third bottom panels, respectively, at end edges thereof remote from said wall panels along fold lines, said first and second divider panels each separated into first and second sections by fold lines extending perpendicular to the fold lines between said wall and bottom panels; each of said first and third bottom panels being separated into first and second portions by a fold line extending from a corner thereof adjacent said wall panels and adjacent said second and fourth bottom panels, respectively, and terminating at an end of the fold line between said first and second sections of the respective divider panel, said second portions of said first and third bottom panels being adjacent and fixed to exterior surfaces of said second and fourth bottom panels, respectively; and a handle coupled to said divider panels at an edge thereof remote from said bottom panels.

2. A carton according to claim 1, wherein said handle comprises first and second handle panels coupled to said first and second divider panels, respectively, at end edges thereof remote from said bottom panels.

3. A carton according to claim 2, wherein slits extend along the junctures between said handle panels and said divider panel first sections.

4. A carton according to claim 1, wherein said second and fourth bottom panels are generally trapezoidal with approximately 90° angle corners adjacent said first and third bottom panels, respectively.

5. A carton according to claim 1, wherein said fold lines between said first and second sections of each said divider panel comprise two discontinuous, colinear fold line segments extending from opposite end edges of the respective divider panel and having adjacent ends interconnected by a generally U-shaped slit, and said U-shaped slits define tabs which are formed from said second sections and which are extensions of said first sections.

6. A carton with a plurality of cells, comprising: first, second, third and fourth wall panels hingedly coupled at adjacent side edges thereof along fold lines; and collapsible means for automatically forming a bottom, partitions and a handle, said means being hingedly coupled to bottom edges of said wall panels along fold lines and comprising, first, second, third and fourth bottom panels hingedly coupled to bottom edges of said first, second, third and fourth wall panels, respectively, along colinear fold lines, each of said first and third bottom panels being separated into first and second portions by an angled fold line extending from a corner thereof adjacent said wall panels and adjacent said second and fourth bottom panels, respectively, said second portions of said first and third bottom panels being adjacent and fixed to exterior surfaces of said second and fourth bottom panels, respectively, first and second divider panels hingedly coupled to said first and third bottom panels, respectively, at end edges thereof remote from said wall panels along fold lines, said first and second divider panels each separated into first and second sections by two discontinuous, colinear fold line segments extending perpendicular to said colinear fold lines and extending from opposite end edges of the respective divider panel with adjacent ends interconnected by a generally U-shaped slit, each said U-shaped slit defining a tab which is formed from the respective second section and which is an extension of the respective first section, one of said segments in said first and second divider panels extending from said angled fold line in said first and third bottom panels, respectively, and first and second handle panels coupled to said first and second divider panels, respectively, at end edges thereof remote from said bottom panels, slits extending along the junctures between said handle panels and said divider panel first sections.

7. A planar, unitary blank for forming a carton with a plurality of cells, comprising:

first, second, third and fourth side panels sequentially arranged and hingedly coupled at adjacent side edges thereof along fold lines;

first, second, third and fourth bottom panels hingedly coupled to said first, second, third and fourth side panels, respectively, at end edges thereof along fold lines;

first and second divider panels hingedly coupled to said first and third bottom panels, respectively, at end edges thereof remote from said side panels along fold lines, said first and second divider panels each separated into first and second sections by fold lines extending perpendicular to the fold lines between said side and bottom panels;

each of said first and third bottom panels being separated into first and second portions by a fold line extending from a corner thereof adjacent said side panels and said second and fourth bottom panels, respectively, and terminating at an end of the fold line between said first and second sections of the respective divider panel; and at least one handle panel coupled to one of said divider panels at an end edge thereof remote from the respective bottom panel.

8. A planar, unitary blank according to claim 7, wherein first and second handle panels are coupled to said first and second divider panels, respectively, at end edges thereof remote from said bottom panels.

9. A planar, unitary blank according to claim 8, wherein slits extend along the junctures between said handle panels and said divider panel first sections.

10. A planar, unitary blank according to claim 7, wherein said second and fourth bottom panels are generally trapezoidal.

11. A planar, unitary blank according to claim 7, wherein said fold lines between said first and second sections of each said divider panel comprise two discontinuous, colinear fold line segments extending from opposite end edges of the respective divider panel and having adjacent ends interconnected by a generally U-shaped slit, and each said U-shaped slit defines a tab which is formed in the respective second section and which is an extension of the respective first section.

12. A planar, unitary blank for forming a carton with a plurality of cells, comprising:

first, second, third and fourth side panels sequentially arranged and hingedly coupled at adjacent side edges thereof along fold lines;

first, second, third and fourth bottom panels hingedly coupled to said first, second, third and fourth side panels, respectively, at end edges thereof along colinear fold lines, each of said first and third bottom panels separated into first and second portions by an angled fold line extending from a corner thereof adjacent said side panels and said second and fourth bottom panels, respectively;

first and second divider panels hingedly coupled to said first and third bottom panels, respectively, at end edges thereof remote from said panels along fold lines, said first and second divider panels each separated into first and second sections by two discontinuous, colinear fold line segments extending perpendicular to said colinear fold lines and extending from opposite end edges of the respective divider panel with adjacent ends interconnected by a generally U-shaped slit, each said U-shaped slit defining a tab which is formed in the respective second section and which is an extension of the respective first section, one of said segments in said first and second divider panels extending from said angled fold line in said first and third bottom panels, respectively; and first and second handle panels coupled to second sections of said first and second divider panels, respectively, at end edges thereof remote from said bottom panels, slits extending along the junctures between said handle panels and said divider panel first sections.

* * * * *